United States Patent [19]

Avison et al.

[11] Patent Number: 4,640,320

[45] Date of Patent: Feb. 3, 1987

[54] AUTOMATIC TIE GUN

[75] Inventors: Gerald Avison; John W. Teape; Paul H. F. Willer, all of Cambridge, England

[73] Assignee: Bowthorpe-Hellermann Limited, Crawley, England

[21] Appl. No.: 651,873

[22] Filed: Sep. 18, 1984

[30] Foreign Application Priority Data

Sep. 20, 1983 [GB] United Kingdom ..... 8325138
May 9, 1984 [GB] United Kingdom ..... 8411828

[51] Int. Cl.[4] ..... B21F 9/02

[52] U.S. Cl. ..... 140/93 A; 24/16 PB; 140/93.2

[58] Field of Search ..... 140/93.2, 123.5, 123.6, 140/93 A; 24/16 PB

[56] References Cited

U.S. PATENT DOCUMENTS 4,359,070 11/1982 Hidassy et al. ..... 140/123.6
4,495,972 1/1985 Walker ..... 140/93.2
4,498,506 2/1985 Moody et al. ..... 140/93 A

*Primary Examiner*—Lowell A. Larson
*Attorney, Agent, or Firm*—Lockwood, Alex, FitzGibbon & Cummings

[57] ABSTRACT

A gun for applying cable ties includes a pinch wheel for acting on the flat tail of the tie to drive the tie from the gun, the tie being guided (as it is advanced, tail-first) around a nose loop guide. The tie finishes with its head engaged with a threader which is then lifted to lift the tie head and thus cause the tail to pass through the head aperture, become interlocked therein and project from the lower side of the head. Then the threader is lowered to lower the head and engage the projecting end of the tail with a pinch wheel which serves to tension the tie. The ties are fed from a bandolier of side-by-side ties in which they are interconnected at their heads and tail tips by continuous strips running along the edges of the bandolier, successive ties being cut from the bandolier while leaving the two strips intact.

24 Claims, 15 Drawing Figures

FIG.6.
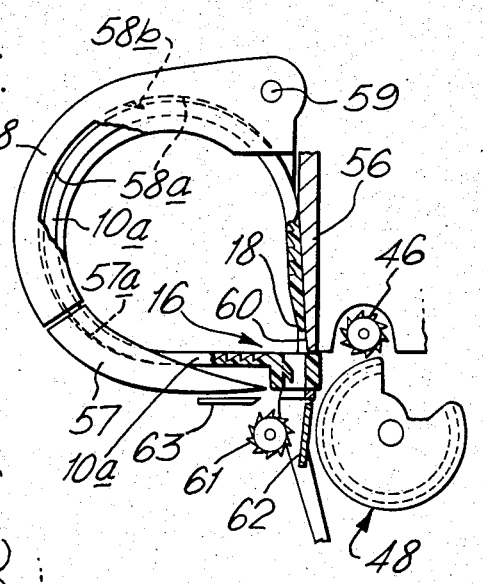
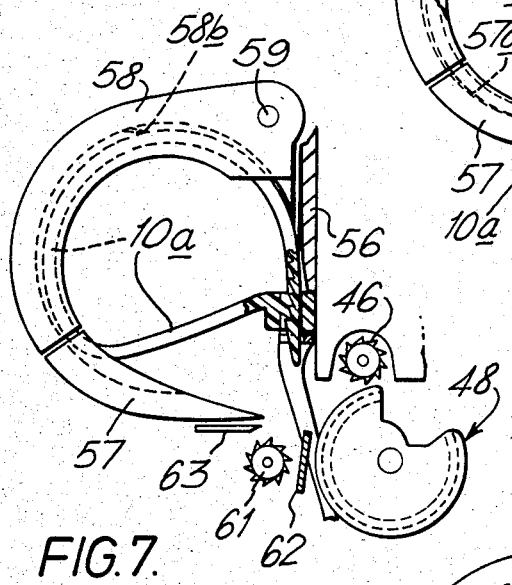
FIG.7.
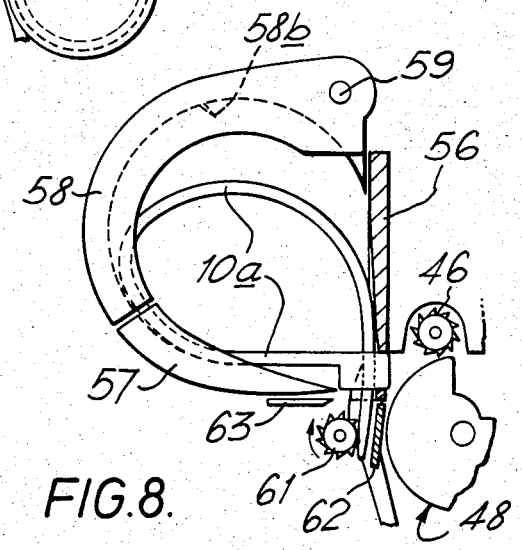
FIG.8.

AUTOMATIC TIE GUN

This invention relates to an automatic gun for applying flexible, one-piece plastics ties around for example a bundle of cables, each tie having a flat tail and an apertured head at one end of the tail. The invention further relates to a bandolier of ties for use by the gun.

United Kingdom patent specification No. 2 072 614 represents the first proposal of an automatic tie gun which feeds from a supply of ties in the form of a bandolier or belt in which the ties are disposed side-by-side with each other and are interconnected by integral bridging elements. This arrangement provides very considerable advantages as regards feeding the gun because the ties can be moulded in bandolier form and do not require assembling individually into a magazine, as in other guns. The gun described in United Kingdon specification No. 2 072 614 includes indexing means for advancing the bandolier such that the leading tie thereof is stepped laterally into a tail-forward, ready position within the gun, means for cutting the leading tie from the bandolier, means for driving tail-first from the gun the tie which is in the tail-forward, ready position, and means at the forward end of the gun for guiding the tie tail around the bundle to be tied as the tie is driven from the gun and arranged so that the free end of the tail passes through the apertured head to interlock therein. The gun further includes means for engaging the free end of the tail (once passed through said apertured head) and driving it to tension the ties around the bundle being tied, a knife for cutting the tail behind the head and a tension-sensing means for actuating said knife when a predetermined tension in the tie is reached.

In the gun illustrated in the drawings of United Kingdom specification No. 2 072 614, a reciprocating push rod is provided for pushing the tie tail-first out of the gun and this push rod is provided with means for engaging the free end of the tail (once passed through said apertured head) so that the return movement of the push rod serves to pull the tail through the head and tension the tie. However the required length of stroke of the push rod necessarily leads to the gun having an undesirably large overall length bearing in mind it is preferably to be hand-held in use and therefore compact and light in weight.

In accordance with this invention as seen from one aspect, there is provided an automatic tie gun having means for driving tail-first from the gun a tie which is in a tail-forward, ready position within the gun, which means comprises a driven pinch wheel engaging the tie tail. This enables the overall length of the gun to be considerably reduced. In an embodiment to be described herein, the pinch wheel engages a flat side of the tail which is provided with a series of transverse serrations for interlocking with a toothed pawl in the head aperture of the tie: the pinch wheel is formed with teeth complementary to the tail serrations so that a positive drive to the tail is provided in the manner of a rack-and-pinion drive. In the embodiment of ties to be described, the tail-entry side of the head aperture is flush with the serrated side of the tail (the aperture extending generally transversely of the plane of the tail) and the series of serrations extends along the length of the tail as far as said head aperture. In this embodiment the tie head projects away from the pinch wheel. Further, for advancing the head past the pinch wheel, a rotatable cam is provided and arranged to rotate, upon sensing arrival of the head at the pinch wheel, and in so doing bear on the trailing end of the head to push the tie through its final travel.

In the gun illustrated in the drawings of United Kingdom specification No. 2 072 614, the head of the tie is bent relative to the remainder of the tail so that its aperture is ready to receive the free end of the tail as the tail (after being guided around the bundle to be tied) is guided back into the gun and whilst the head is being driven forwardly over the final portion of its travel. This bending of the head leads to complexities and so to does removal of the tail end of the tie in the same passage as the next tie is to be driven forwardly during its application.

In accordance with this invention as seen from a second aspect, there is provided an automatic tie gun having means for driving tail-first from the gun a tie which is in a tail-forward, ready position within the gun, means at the forward end of the gun for guiding the tie tail around the bundle to be tied as the tie is driven from the gun so that, upon completion of the tie-driving step, the free end of the tail is spaced from the head but is aligned with and directed towards the head aperture, and threading means for next displacing the head towards the free end of the tail (so that the latter passes through and interlocks within said aperture) and then carrying the head in the return direction. The tail interlocks within the head upon the initial displacement of the head by the threading means, and the return movement of the threading means serves, whilst carrying the tie head, to advance the free end of the tail into engagement with means for tensioning the tail. These arrangements avoid the complexities referred to in the previous paragraph. Preferably the tail tensioning means comprises a rotatable wheel preferably formed with teeth complementary to and engaging the tail serrations to provide a positive drive of rack-and-pinion type.

In the gun illustrated in the drawings of United Kingdom specification No. 2 072 614, the indexing means comprises a drum rotatable about its longitudinal axis and formed with a plurality of longitudinal slots into which the ties of the bandolier register, so that rotation of the drum serves to advance the bandolier. The bandolier has its adjacent ties interconnected at two points along the length of their tails, adjacent the tie tips and the tie heads, by integral bridging pieces. In severing each tie from the bandolier, two small bridging pieces have to be cut away and ejected. The mechanisms for cutting away the bridge pieces and for ejecting them reliably (so that they will not lead to jamming of the gun) are however complicated. Also the arrangements for engaging each fresh bandolier of ties with the gun are complicated and do not provide for easy and rapid operation.

In accordance with this invention as seen from a third aspect, there is provided an automatic tie gun which feeds from a bandolier of ties interconnected side-by-side, the gun comprising a gate for guiding the bandolier to the indexing means, said gate having an entry slot for the bandolier and being readily displaceable from a receiving position to an operating position, such that in the receiving position the leading end of a fresh bandolier may be inserted into the gate through said entry slot for the leading tie to become located in a predetermined position within the gate, said displacement of the gate serving to engage the leading tie of the bandolier with the indexing means. These arrangements provide for easy and rapid engagement of each fresh bandolier.

In the embodiment to be described herein, the gate is mounted for pivoting between its operating and receiving positions. The leading tie locates past two pawls of the gate. The indexing means comprises a rotatable body with recesses spaced apart around its periphery to receive the ties and so as to advance the bandolier by its rotation, in the manner of a drum with longitudinal slots but discontinuous along its length. In the bandolier for this embodiment of gun, the ties are interconnected side-by-side by two integral and continuous filaments running lengthwise of the bandolier (i.e. transverse to the ties), one filament interconnecting the tail tips and the other filament interconnecting the tie heads. The gate includes fixed cutting blades for severing the successive ties from the two filaments upon the advancement of the bandolier, the two filaments being maintained continuous and advancing into a waste compartment. The previous difficulties of cutting and removing separate bridge pieces are thus avoided.

In the embodiment of gun to be described, an electric motor is the sole power unit. Gear trains transmit drive from the motor to an indexing means for advancing the bandolier, to a rotatable pinch wheel for engaging the tie tail to drive the tie out of the gun, to a rotatable cam wheel for driving the tie head past the pinch wheel, to a threading means which serves to displace the head so as to engage with the free end of the tie tail, to a rotatable pinch wheel for tensioning the tie, and to an actuator for a cutter which serves to sever the tie tail at the exit side of the head. The gear trains include four clutches which are triggered at appropriate points in the operating cycle to transmit or interrupt drive as required to the indexing means, the cam wheel, the threading means and the actuator for the cutter.

In previous automatic tie guns, relatively complex arrangements have been employed for sensing when the tie has been tightened to a predetermined tension and for then actuating a cutter to sever the free end of the tail projecting from the tie heads.

In accordance with this invention as seen from a fourth aspect, there is provided an automatic tie gun comprising a rotatable wheel for engaging the free end of the tail projecting through the head of the tie for thereby pulling the tie through the head to tension the tie around the bundle, a drive motor, a transmission system for transmitting drive from the motor to the tensioning wheel and including a clutch arranged for its input and output elements to slip at a predetermined loading on the tensioning wheel (which indicates a predetermined tension in the tie tail) and for its input element to engage with and drive another output element which serves to operate a cutter, which severs the tie tail flush with the exit surface of the tie head. This arrangement is relatively simple and compact.

Embodiments of this invention will now be described, by way of example only, with reference to the accompanying drawings, in which:

FIG. 6 is a diagrammatic side view of a nose loop guide of the gun, showing the tie guided around this loop just at the end of driving the tie out of the gun;

FIG. 7 is a similar view when a threader component has lifted the tie head to effect threading of the tie tail through the head;

FIG. 8 is a similar view after the threader has been lowered again;

TIE BANDOLIER

Figure 1:
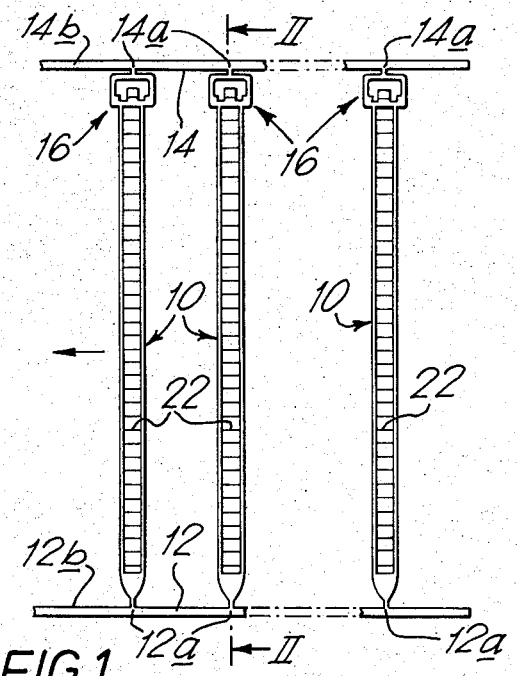
FIG. 1 is a plan view of a tie bandolier in accordance with this invention.
Figure 2:
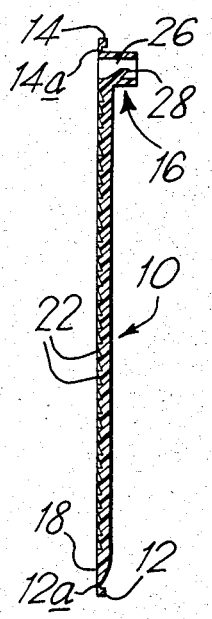
FIG. 2 is a section on the line II—II of FIG. 1.

Referring to FIGS. 1 and 2, a tie bandolier 1 is shown comprising ties 10 disposed side-by-side and interconnected by narrow strips 12, 14 running along lines beyond the tail tips 18 and tie heads 16, respectively, and connected to the tail tips and the heads by short filaments 12*a*, 14*a* respectively. In each tie, the tail has one side formed with a series of transverse ratchet serrations 22 and (at one end) the head 16 projects from the other side of the tail and is itself wider than the tail. The head has an aperture 26 extending generally transversely of the plane of the tail, from the serrated side of the tail. The series of serrations 22 extend as far as the entry side of aperture 26 as shown. Within this aperture there is formed a pivoted pawl 28 having teeth complementary to the ratchet serrations of the tail. Upon passing the free end of the tail through the head from the entry side of the aperture, the pawl rides on the serrations to permit free passage of the tail but any return movement of the tail is prevented by an interlock between the pawl in the head and the serrations on the tail.

TIE GUN - GENERAL

A gun, for feeding from the bandolier of FIGS. 1 and 2, is shown in the drawings and is a hand-held tool which achieves the requirements of light weight, compactness, and ease of use. An electric motor is the sole power unit and electric current is supplied to the gun from a separately mounted power pack over a conventional electric lead, which places very little restriction on the manoeuvrability of the hand-held gun. Also to minimise restriction, preferably each bandolier of ties is relatively short, typically with 20 ties or up to 100 ties for example in each bandolier. It is however a quick and easy operation to engage each fresh bandolier with the gun.

Figure 3:
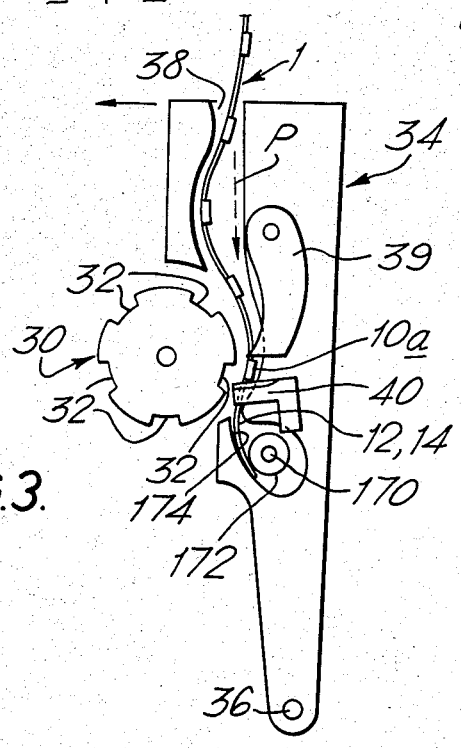
FIG. 3 is a diagrammatic view of a gate and indexing drum arrangement of the gun, the view being simplified to clarify the principles of operation.

Referring to FIGS. 3 to 8, a description will be given of the basic principles of construction and operation of the gun. The gun comprises an elongate indexing drum 30 (FIGS. 3 and 4) disposed with its axis running front-to-back of the gun. The drum comprises a number of disc-like elements mounted at intervals along a rotatble shaft, each disc-like element having five recesses 32 spaced apart around its circumference, the recesses in each disc-like element being aligned with the respective recesses in the other disc-like elements. The drum thus provides for receiving and locating successive ties of the bandolier at five equally-spaced positions around its circumference. As shown in FIG. 3, a gate 34 is disposed along one side of the gun (the right hand side as viewed from the front) and may be pivoted about an axis 36 at a level lower than the drum 30. In FIG. 3 the gate is shown pivoted away from the drum, and into a receiving position. In this receiving position, a bandolier 1 may be inserted into the gate through a slot 38 along its top. The gate incorporates a guide passage serving to guide the bandolier, as it is inserted through the entry slot 38, generally downwardly, then in an arc so as to skirt circumferentially around the right-hand side of the indexing drum. Spring biased pivoted pawls 39 are disposed adjacent each end of the gate, and fixed cutting blades 40 are also provided adjacent each end of the gate. The leading tie 10*a* of a fresh bandolier, when inserted, depresses and passes beyond the pawls 39 to become located between the pawls 39 and the blades 40, the blades 40 contacting the filaments 12*a*, 14*a* of the leading tie. The gate is then pivoted towards the drum and automatically latches in position. As a result of this closing movement, the leading tie 10*a* is engaged into one set of the tie-receiving recesses of the indexing drum, being one step from the bottom or 6 o'clock position of the drum, as indicated in FIG. 3.

Figure 4:
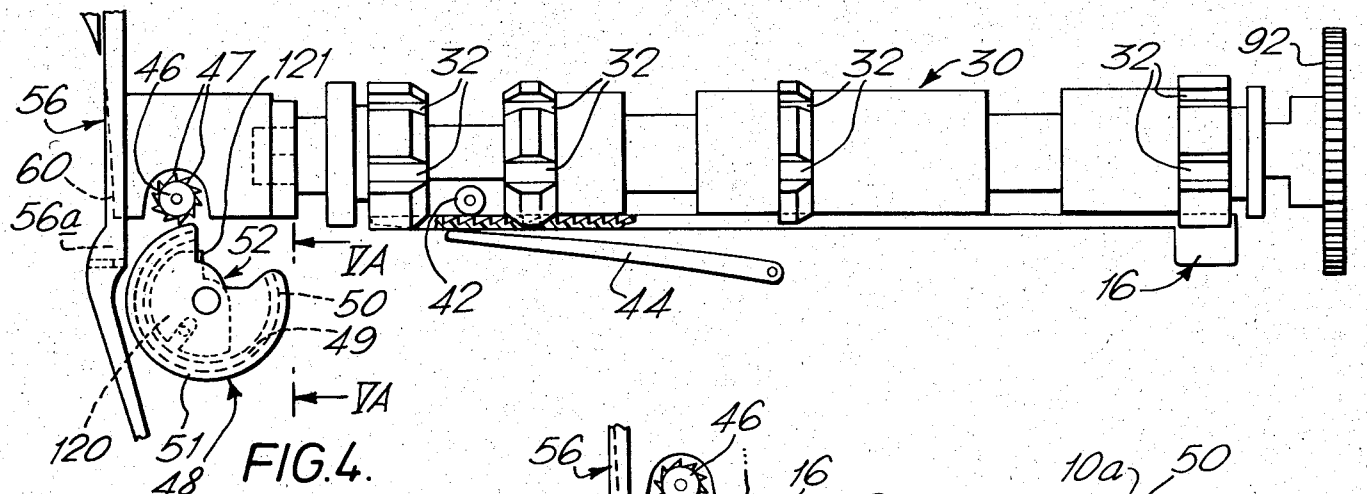
FIG. 4 is a simplified, diagrammatic side view of the indexing drum and also of the principal tie driving and threading components of the gun, to illustrate the principles of operation.

When the gun is actuated, the indexing drum is rotated through one step, carrying the leading tie into the bottom or 6 o'clock position. In this movement, the leading tie is driven past the fixed cutter blades 40 of the gate, to sever the tie from the bandolier. The strips 12, 14 of the bandolier are guided downwardly (out of the gate). The bandolier is engaged with the drum such that the tie tails are directed towards the front of the gun, and the serrated side of the tails face the drum axis and the heads project away from the drum axis. Thus, once the leading tie has been stepped (laterally of itself) into the bottom or 6 o'clock position of the drum, it is positioned as shown in FIG. 4: the tail of tie 10*a* is directed towards the front of the gun, the serrated side of the tail faces upwards and the tie head projects downwards. This is the tail-forward, ready position of the tie within the gun.

In moving into this ready position, the tie tail is inserted between a toothed pinch wheel 42 and a pressure plate 44. Forwardly of the indexing drum, there is a main pinch wheel 46 for driving the tie tail-first out of the front of the gun, but the purpose of pinch wheel 42 is to provide an initial drive to the tie to advance its tail into engagement with the main pinch wheel 46. The initial pinch wheel 42 acts on the upper (serrated) side of the tail and the pressure plate 44 is spring biased upwardly to press the tail against the initial pinch wheel: during advancement of the tie by the main pinch wheel 46, the pressure plate will be depressed by the tie head so as to permit the tie head to pass beyond the prssure plate.

Figure 5A:
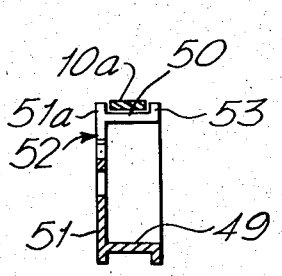
FIG. 5A is a diagrammatic section of the cam wheel on the line $\overline{VA}$—$\overline{VA}$ of FIG. 5.
Figure 5:
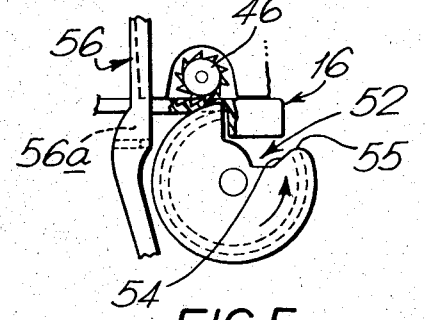
FIG. 5 is a view of a cam wheel of the gun at a time it is about to act on the tie head to advance the tie the final portion of its travel out of the gun.

The main pinch wheel 46 is provided with teeth 47 complementary in profile to the transverse ratchet serrations of the tie tail. These teeth 47 engage with the tie serrations to provide a positive drive to the tie, in the form of a rack-and-pinion drive. A cam wheel 48 is disposed below the main pinch wheel 46 and is normally fixed against rotation to provide a reaction surface for the main pinch wheel, the tie being driven between the main pinch wheel and the cam wheel. The cam wheel comprises a ring-shaped portion 49 presenting a cylindrical outer surface 50, the ring-shaped portion 49 being interrupted as shown for part of its periphery. The ring 49 is united with a disc-shaped portion 51 at one of its sides, the disc 51 being of larger diameter than the ring 49 and provided with a recess 52 over part of its periphery corresponding with the interruption in the ring 49. The other side of the ring 49 is left open, but a flange 53 is provided around its periphery, corresponding to that portion 51*a* of disc 51 which projects radially outwards from the cylindrical outer surface 50 of the ring. This radially-outer portion 51*a* of disc 51, at one side of the ring, and the corresponding flange 53, at the other side of the ring, provide a channel just wider than the tie tail, to allow this tail to pass (see FIG. 5A). The cam wheel is shown in its normal, fixed position in FIGS. 4 to 7, the reaction surface for the main pinch wheel 46 being provided by the surface 50 of ring 49, just adjacent the recess 52.

The tie can be advanced by the pinch wheel 46 until the tie head 16 arrives. When the tie has reached the position shown in FIG. 5, the head 16 having been received into the recess 52, a feeler 120 senses the arrival of the head and causes drive to be transmitted to the cam wheel to rotate the latter through 360° in the counterclockwise direction as viewed in FIGS. 4 to 8. The effect of this rotation is firstly for the rear edge 54 of the recess 52 to bear on the outer end of the tie head and thus advance the tie: as rotation continues, next a curved transition 55 (provided on both the outer portion 51*a* of the disc and on the flange 53) bears on the outer end of the tie head to further push the tie forwards, and finally the outer rims of the disc and flange bear on the outer end of the tie head, completing its advance. The tie has been driven through an opening 56*a* in a threader component 56, finishing with the tie head 16 now located within this opening, as shown in FIG. 6.

In being driven tail-first out of the front of the gun, the tie tail has been guided around a nose loop guide which comprises a fixed lower guide 57 and an upper guide 58 (which is pivoted at 59 for closing around the bundle of cables to be tied). The guides 57 and 58 are formed with grooves 57*a*, 58*a* for receiving the tie tail and constraining it against sideways movement. Firstly the tie tail is guided along the lower guide 57, then around the upper guide 58, and finally downwardly in a groove 60 at the front of the threader 56. At the finish of the tie-driving step, the head has become located within the threader opening 56*a*, but the tip 18 of the tie tail is spaced slightly from the tie head, yet is aligned with and directed downwardly towards the aperture 26 through the tie head: the tie at this stage is shown in FIG. 6.

At this point in the operating cycle, drive is transmitted to the threader component to lift it so as to lift the tie head. The free end of the tail is unable to move, so the effect of lifting the tie head is for the tail to be threaded through the head aperture 26 (in which it interlocks) and to project from the lower side of the head (see FIG. 7). Then the threader 56 is lowered or returned to its normal position, carrying the tie head and also the end portion of the tie tail (because the tail has become interlocked with the pawl 28 within the head 16). The end portion of the tail, projecting from the lower side of the tie head, is accordingly inserted into the nip between a pinch wheel 61 and a fixed reaction plate 62, as shown in FIG. 8. Drive is transmitted to the pinch wheel 61 to pull the tail downwardly through the head and to thus tighten the tie around the bundle of cables. Pinch wheel 61 has teeth complementary to the tie serrations so as to provide a positive, rack-and-pinion type drive. A device is provided for sensing when a predetermined tension in the tail is reached, in response to which drive is transmitted to an actuator serving to advance a cutter blade 63 against the tail to sever it just below the lower side of the head.

A timing circuit is provided within the gun, serving to stop the electric drive motor and open the nose loop guide after a period of time sufficient to allow the application, tensioning and cut-off of the tie as just described.

TIE GUN - ARRANGEMENT OF MECHANISMS

FIGS. 9–12 show the gun with its casing removed. The gun comprises a chassis which includes two parallel plates 70, 71 extending generally from the rear to the front of the gun. At the upper, rear portion of the chassis, the electric motor 72 is mounted with its drive shaft 73 aligned lengthwise of the gun. A conventional pistol-grip style of handle 74 is provided with a trigger 75 for initiating a tie-applying cycle of operation of the gun. The nose loop guides 57 and 58 are mounted at the front of the chassis. In an opening of plate 70 (i.e. along the right hand side of the chassis as viewed from the front of the gun), there is disposed the indexing drum 30. The gate 34 is positioned at the right hand side of the gun.

Along the outside of plate 71 (i.e. along the left hand side of the chassis as viewed from the front of the gun), there is disposed a linkage arrangement 76 for closing the upper guide 58 onto the lower guide 57, in response to pressing the trigger 75.

Generally between the two parallel plates 70, 71, are disposed the various tie driving, threading, tensioning and cutting components which have been described with reference to FIGS. 4 to 8 (i.e. the initial pinch wheel 42 and its pressure plate 44, the main pinch wheel 46 and cam wheel 48, the threader 56, tensioning pinch wheel 61 and reaction plate 62, and the tail cutter blade 63. Also between plates 70, 71 are disposed systems for transmitting drive to the indexing drum, to the driving pinch wheels 42 and 46, to the cam wheel 48, to the actuator for moving threader 56, to the tensioning wheel 61 and to the actuator for moving the tail cutter blade 63.

NOSE LOOP GUIDE CLOSURE

Figure 9:
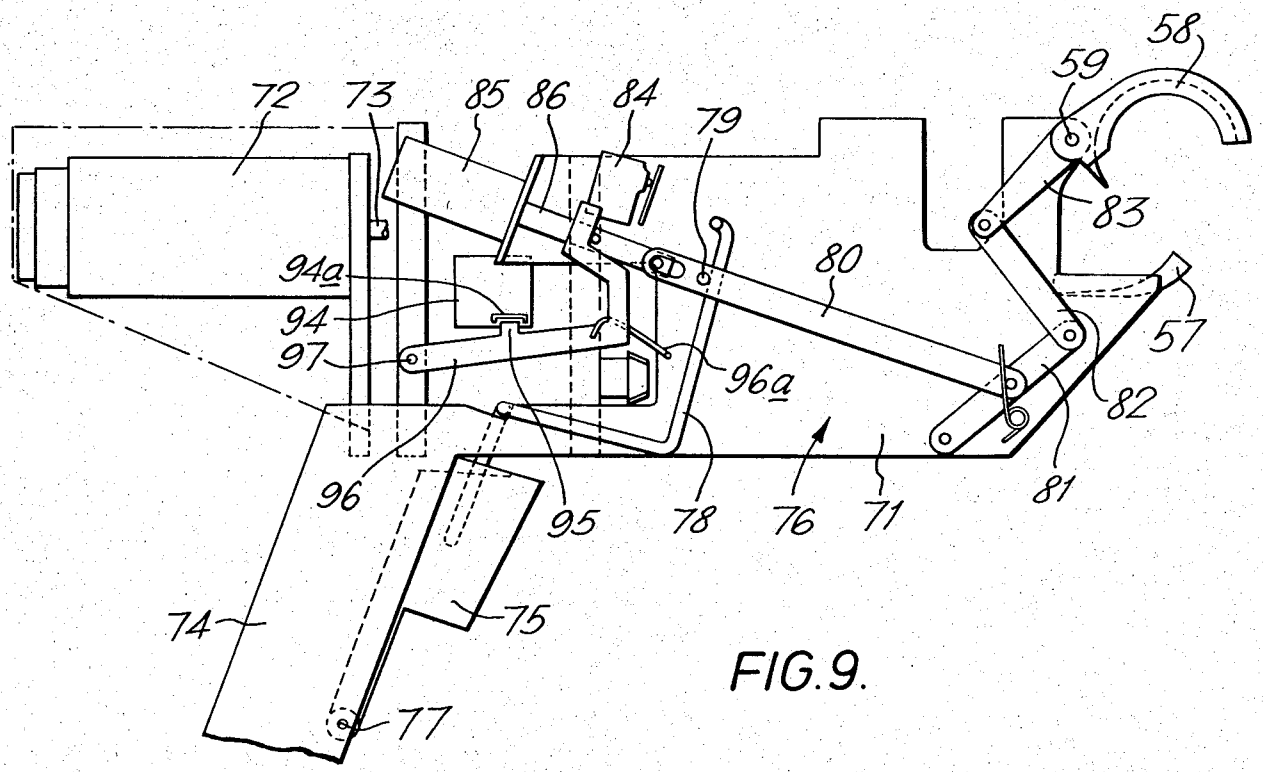
FIG. 9 is a side view of an embodiment of gun, shown with its casing removed.

Referring to FIG. 9, pressing the trigger 75 pivots it about point 77. An arm 78 is carried by the trigger and acts via a pin 79 to displace a main link 80 and thus nearly straighten a strut which is formed of links 81, 82, thus closing the upper guide 58 by pivoting it about its pivot point 59. It wil be noted that links 81, 82 are pivoted to each other, the lower link being pivoted to the plate 71 and also (at an intermediate point) to the main link 80: the upper link 82 is pivoted to a rearwardly extending operating arm 83 of the upper guide. Arm 78 also presses a microswitch 84 to energise a solenoid 85: solenoid armature 86 is connected to main link 80 to displace it slightly further and thus effect complete straightening of the strut 81, 82, such that any force externally applied to the upper guide 58 will be unable to open it.

DRIVE TO INDEXING DRUM

Figure 10:
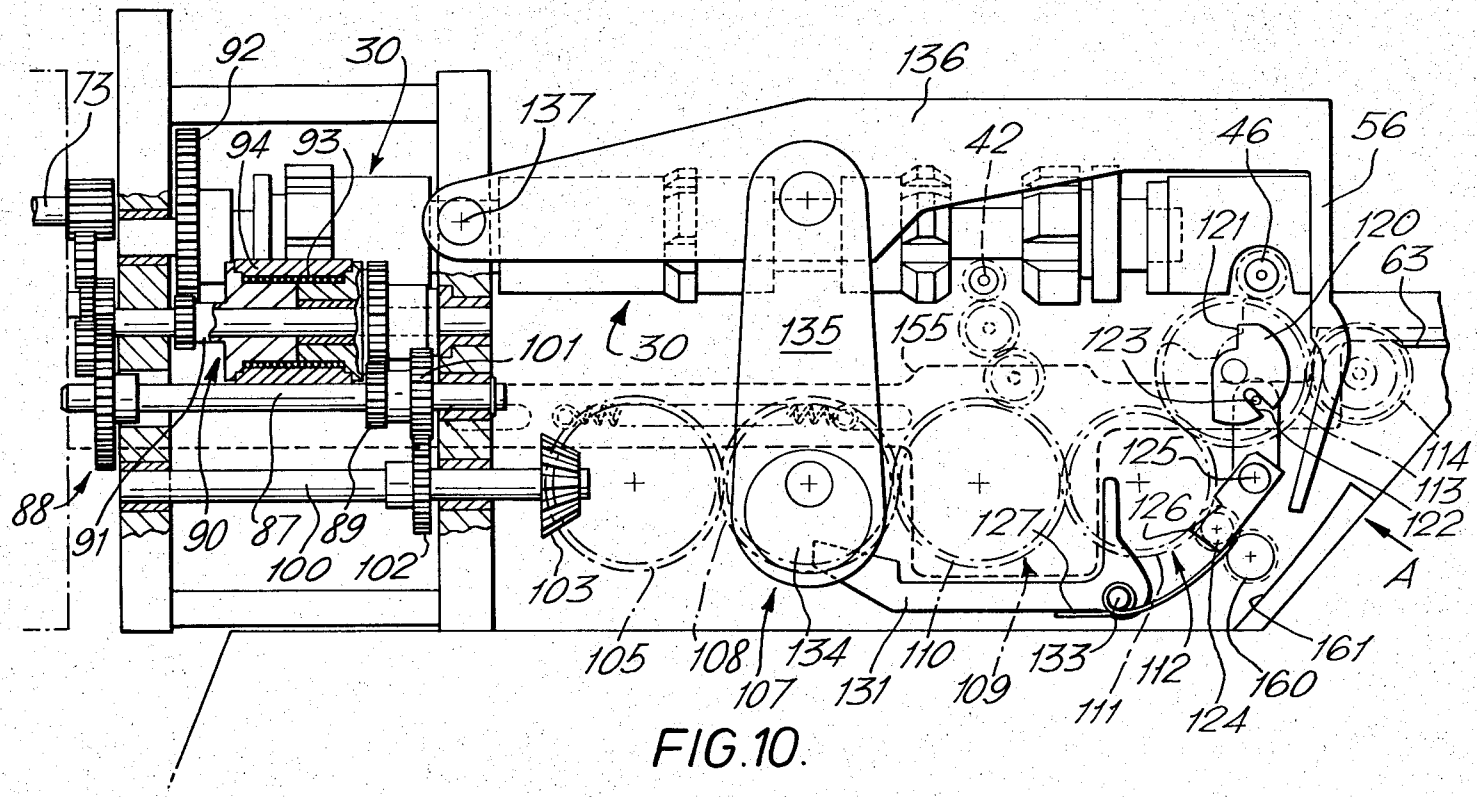
FIG. 10 is a view from the same side of the embodiment of gun, showing the chassis plate of that side removed to illustrate working mechanisms of the gun, which mechanisms are shown simplified and with parts removed.

Motor shaft 73 drives a shaft 87 via a gear box 88 (FIG. 10). A gear 89 on shaft 87 drives the input element of a clutch 90, the output element 91 of which drives a gear 92 on the rear end of the indexing drum 30 (see also FIG. 4). The clutch is a spring-wrap type of clutch: i.e. it comprises a helical spring 93 wrapped around cylindrical stems on the input and output elements, one end of the spring being fixed to the output element and the other end of the spring being fixed to a control cylinder 94 which surrounds the spring. When the control cylinder is allowed to rotate, the spring is free to tighten up and contract onto the cylindrical stems of the input and output elements, such that the output element will be driven by the input element (i.e. the clutch is engaged). When the microswitch 84 is closed (upon pressing the trigger 75), the motor 72 is energised and drive is transmitted to the shaft 87, through the clutch 90 to the gear 92 of the indexing drum. However, once the input element of the clutch has turned through 360° (the output element and the control cylinder 94 also turning through 360°), a stop **94*a* (FIG. 9) on the outer surface of control cylinder 94 arrives at a detent 95 of a blade 96: detent 95** abuts the stop to stop the control cylinder and to thereby disengage the clutch (the wrap spring no longer being free to contract onto the cylindrical stems of both input and output elements). The indexing drum has been rotated through one step (1/5th of a revolution) and then stopped.

Blade 96 is coupled to the solenoid armature and is pivoted about point 97 when the solenoid is energised: the detent then slides on the surface of the clutch control cylinder until it is abutted by the stop **94*a*, also having the effect of displacing blade 95 in the direction of rotation. When, at the end of an operating cycle, the solenoid is de-energised, a spring 96*a* acting on blade 96 serves to pivot the blade away from the clutch, but also to lift it out of the plane of the paper on which FIG. 9 is drawn: thus when the solenoid is again energised, the detent 95** contacts the clutch control cylinder behind the stop, so that the control cylinder is free to rotate.

DRIVE TO PINCH WHEELS

Figure 11A:
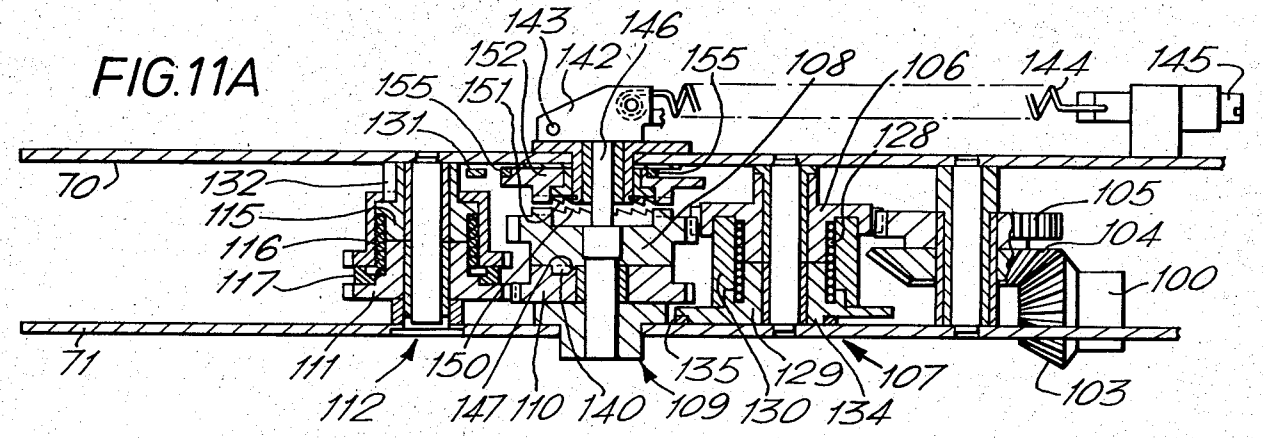
FIGS. 11A and 11B are respectively views from the bottom and in the direction of arrow A (in FIG. 10) to illustrate in detail the various gear trains and transmission systems.
Figure 12B:
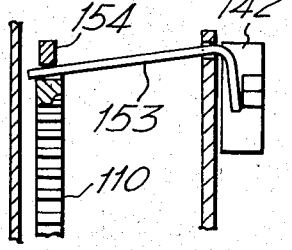
FIGS. 12A and 12B are a view from below and a section on $\overline{X11B}$—$\overline{X11B}$ of FIG. 12A, respectively, to show a latch operative for tie tensioning and cutting.
Figure 12A:
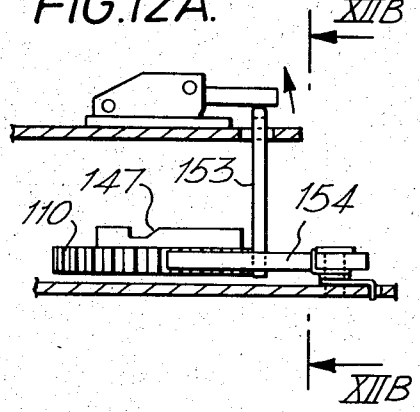
Figure 11B:
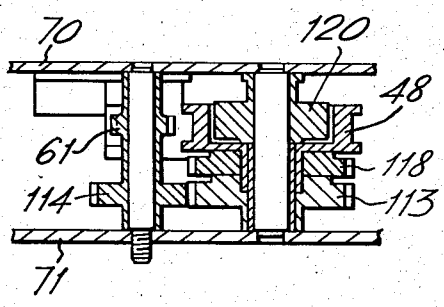

Shaft 87 is coupled to a shaft 100 via gears 101, 102 and shaft 100 carries a crown gear 103 to transmit drive to a spur gear 104, which carries a gear 105 (FIGS. 10 and 11). Gear 105 transmits drive to an input element 106 of a clutch 107, this input element 106 transmits drive to an input element 108 of a clutch 109. Clutch 109 has an output element 110 transmitting drive to the input element 111 of a clutch 112. This input element 111 is coupled to a gear 113 which is coupled to a gear 114: gear 114 is on the drive shaft of the tensioning pinch wheel 61. The main pinch wheel 46 is carried on a shaft which also carries a gear wheel, which gear wheel is meshed with gear 113 at the top of the latter. The initial pinch wheel 42 is driven through a gear box having its input meshed to gear 110. Thus, whilst the motor is energised, drive is transmitted continuously to the initial pinch wheel 42, and it is also transmitted continuously to the main pinch wheel 46 and the tensioning pinch wheel 61 until the predetermined tension in the tie is reached, as will be described.

CAM WHEEL DRIVE

Clutch 112, when triggered, serves to transmit drive to the cam wheel to effect rotation of the cam wheel through its required 360°. Clutch 112 is another spring wrap clutch and has an output element 115, a helical spring 116 coupling the input and output elements 111 and 116, and also a control ring 117. Normally a latch 124 (see below) is engaged in recesses both in the control ring 117 and the output element 116 to prevent these from rotating: thus the clutch is normally disengaged. The feeler 120 serves to release the latch, when the tie head arrives at the cam wheel, and once the latch is released the clutch 112 becomes engaged to transmit drive, via its output element 116, to a gear 118 which is fixed to the cam wheel 48.

The feeler 120 is disposed within the ring 49 of the cam wheel and is mounted for independent rotation about the same axis. Feeler 120 has a radial face 121 which the forward end of the tie head 16 strikes (before the head can contact the cam wheel). This momentarily turns the feeler 120 around its axis. Feeler 120 has a radial slot 122 receiving a pin 123 on a control arm of the latch 124: the momentary turning of feeler 120 causes the latch to be rocked about its pivotal axis 125 and for its detents 126 to be released from the control ring 117 and output element 116 of clutch 112. The feeler 120 will be turned by the tie head, as the cam wheel pushes the head forward, so that the head can pass the feeler: then a spring 127, disposed around the pivot 133 of a lever 131, serves to bias the latch in its return direction, the pin 123 serving to return the feeler 120 to its normal position.

THREADER DRIVE

Clutch 107, when triggered, serves to displace the threader 56. Clutch 107 is another spring-wrap clutch, with a helical spring 128 disposed around cylindrical stems of its input and output elements 106, 129 and a control cylinder 130 around the spring 128. Normally control cylinder 130 is held against rotation (and the clutch disengaged) by a latch lever 131 engaged in a recess in the control cylinder. As the output element 115 of cam clutch 112 approaches the end of its 360° rotation, a pip 132 on the output element 115 strikes the latch lever 131 to momentarily turn it about its pivot point 133 and release the latch from control cylinder 130 of the threader clutch 107. This clutch is thus engaged and its output element 129 is driven through 360° before latch 131 again engages in the recess of control cylinder 130. Output element 129 has an eccentric 134 engaged in one end of a link 135, the upper end of which is coupled to a lever 136 which is coupled at its forward end to the threader 56. Thus, the 360° rotation of the eccentric 134 serves to pivot lever 136 first upwards then downwards about its pivot point 137, thus lifting and then lowering the threader as previously described.

DRIVE TO TAIL CUTTER

In clutch 109, the input and output elements 108, 110 are normally coupled together by three projections (e.g. 140) on the face of element 108 engaged within respective recesses in the mating face of element 110. The three projections, and their corresponding recesses, are disposed at unequal angles around the elements, so that these elements engage with each other only when the input element 108 is in a predetermined rotary position relative to the output element 110. A rocker 142 is pivoted at 143 on the outside of plate 70 and a tension spring 144 acts between rocker 142 and plate 70: a screw 145 enables adjustment of the force applied by spring 144 to rocker 142. Rocker 142 is urged, by the turning force applied to it by the spring 144, against the end of a shaft 146 on which input element 108 is journalled.

When a predetermined tension is reached in the tail of the tie being tensioned, a corresponding predetermined loading is experiences by the tensioning pinch wheel 61. This loading is fed back via gears 113 and 111 to output element 110 of clutch 109. Thus, when the loading on output element 110 differs sufficiently from the drive being applied by the input element 108, the elements 108 and 110 disengage by the projections 140 of element 108 running up complementary cam surfaces 147 on the mating recesses of element 110, the input element 108 thus being displaced axially. The value of loading at which this occurs is set by the axial force urging the elements 108 and 110 together, which force is determined by the tension spring 144.

When the elements 108 and 110 disengage in this manner, the output element is no longer driven and consequently the drive to the main pinch wheel 46 and to the tensioning pinch wheel 61 is interrupted. Also, the axial displacement of input element 108 (away from output element 110) causes a dog ring 150 (which is fixed to element 108) to engage with a dog ring 151, which is fixed to an eccentric 152. Also, the same axial displacement is transmitted by the shaft 146 to pivot rocker 142, and in so doing permit a lever arm 153 to rock and permit a springbiassed detent 154 to engage the teeth of output element 110 and prevent any rotation of it. Input element 108 will now be driven through 360°, driving the eccentric 152 through 360°, before the elements 108, 110 can re-engage (by the projections 140 being received in their respective recesses). By this time, the tie tail will have been cut, as follows: the eccentric 152 is engaged in a plate 155 which carries the cutter blade 63 and a 360° rotation of the eccentric 152 serves to reciproate the plate 155 so as to advance the blade to cut the tail and then retract to its normal position, to which plate 155 is spring-biassed.

WASTE EJECTION

The cut-off length of tie tail is driven downwards and into a waste box (not shown) by a wheel 160, drive for which is taken from gear 111. A plate 161 serves as a reaction surface for this wheel 160 (see FIG. 10).

Referring to FIG. 3, the gate includes a shaft 170 running from front-to-back and carrying knurled rollers 172 adjacent each end, aligned with the strips 12, 14 of the bandolier. The shaft further carries a gear wheel meshing, when the gate is closed, with the gear wheel 92 of the indexing drum. The strips 12, 14 pass between the rollers 172 and reaction surfaces 174 formed on the gate: the rollers serve to drive the final lengths of the strips 12, 14 out of the gate after the last tie of the bandolier has been stepped into the ready position at the bottom of the drum. The gate is opened by the user touching a release key with a finger of the hand not holding the gun, the gate moving into the receiving position under spring bias. When the gate is subsequently pushed to the operating position, it automatically latches.

Reverting to FIG. 3, the bandolier is inserted into the gate in a straight line P, and thus with no resistance, and only when the gate is closed does the bandolier adopt its curvilinear guide path, by virtue of the gate pressing the bandolier (including the strips 12, 14) against the drum. Referring to FIG. 9, the solenoid armature 86 is connected to link 80 by a pin-in-slot coupling, so that the armature can move a small distance independently of link 80 and permit movement of catch 96 in acting upon the indexing drum clutch 94 and at the same time prevent opening of the upper guide 58 in both straight and nearly straight positions of strut 81, 82. To provide another mode of operation, a catch may be provided to act on link 80: this catch may be selectively applied by the operator and will, after a first pressing on the trigger, serve to hold the guide loop 57, 58 closed: the gun can then be fired repeatedly to apply successive ties without the guide loop opening, until the operator releases the catch. In this case a separate spring is required to act on arm 78 for biasing the trigger to its off-position.

In FIGS. 6, 7 and 8, a barb 58*b* is provided on the guide surface of upper guide 58, to dig into the tie tail and help in preventing displacement of the tail when the threader 56 lifts.

We claim:

1. An automatic tie gun for applying a flexible one-piece plastic cable tie around an elongate bundle of cables, each tie having a tie body which includes a tail and apertured head at opposite ends of said tie, comprising:

means for advancing a single tie into a tail-forward, tie driving position within said gun;

means for driving said single advanced tie tail-first from said gun and around said cable bundle;

guide means at the forward end of said gun for guiding the tie tail of said driven tie around the cable bundle such that the free end of said tie tail is spaced apart from said tie head aperture and aligned with said tail head aperture;

means for threading said tie tail of said driven tie while held in said guide means into and through said tie head aperture in interlocking engagement therewith, said threading means being adapted for reciprocatable movement, whereby said tie head is displaced onto said tie tail by the first movement of said threading means and the second reciprocal movement of said threading means carries the interlocked tie head and tail in a direction opposite that of said first movement, and a rotatable wheel for tensioning said driven tie around said cable bundle, said rotatable wheel being adapted to engage said tie tail free end, said second movement of said threading means carrying said free end of said tie tail into engagement with said rotatable tensioning wheel.

2. An automatic tie gun for applying a flexible, one-piece plastics tie around a bundle of cables, each tie having a flat tail and an apertured heat at opposite ends of said tie, the gun being arranged to feed from a bandolier of individual ties interconnected side-by-side and said gun comprising rotatable indexing means for advancing the leading tie of said bandolier into a tail-forward, ready position within the gun, a gate for guiding said bandolier into engagement with said indexing means, fixed cutting blades mounted to the gate for cutting the leading tie free from said bandolier as said bandolier is advanced past the cutting blades by said indexing means, a driven pinch wheel for driving an individual, advanced, tie cut free from said bandolier tail forward from said gun and around said cable bundle, said pinch wheel being adapted to engage said tie tail, a rotatable cam wheel spaced apart from said pinch wheel and adapted to engage said tie head during the driving of said tie by said pinch wheel, such that said cam wheel engages said tie head and advances said tie head past said pinch wheel, guide means at the forward end of said gun for guiding said tie tail of said driven tie around said cable bundle so that said free end of said tail is spaced from said tie head and aligned therewith in said guide means, tie-threading means for displacing said tie head of said driven tie towards said free end of said tie tail such that said tie tail passes through and interlocks with said tie head aperture and projects through said tie head, said threading means further carrying the interlocked tie tail and head into engagement with tie-tensioning means for tensioning said tie around said cable bundle, said tie-tensioning means including a rotatable wheel for engaging said projecting free end of said tail, a cutter for severing said projecting end of the tail of the tensioned tie substantially flush with said tie head when a predetermined tension in the tie is reached, and means for sensing said predetermined to actuate said cutter.

3. An automatic tie gun as claimed in claim 2, further including an electric motor and a transmission system for transmitting drive to said driven pinch wheel and to said tensioning wheel and including a first clutch for transmitting drive to rotate said indexing means, a second clutch for transmitting drive to rotate said cam wheel, a third clutch for transmitting drive to reciprocate said threading means, and a fourth clutch for transmitting drive to reciprocate said tail cutter.

4. A bandolier of flexible ties intended for use in an automatic tie gun for applying an individual flexible tie around an elongate bundle of cables and having means within the gun for separating individual ties from the bandolier during the successive application of said ties around said bundle and driving the non-tie portion of the bandolier to waste after application of an individual tie, individual ties of said bandolier being joined together adjacent one another, wherein said bandolier comprises a plurality of individual flexible ties assembled in the form of a continuous belt, each individual tie having a tie body having a generally flat tail portion and an apertured head portion at opposite ends of said tie body, said tie tail and head portions lying in a substantially common plane, said generally flat tail portions of said ties including a series of transverse serrations extending along the said tail, said individual ties being disposed side-by-side in a predetermined spacing in said common plane and in generally parallel relation with each other and being interconnected successively with one another adjacent the tail and apertured head portions of said ties by two integral flexible continuous filaments said filaments extending the entire length of said bandolier generally perpendicular to said individual ties each of said filaments being adapted to be driven to waste as single, integral waste pieces when separated within said gun from said individual ties, one filament interconnecting said tie tails of successive ties and the other filament interconnecting said tie heads of successive ties, to maintain said individual ties in said predetermined spacing and generally parallel relationship in said common plane.

5. The bandolier of claim 4, wherein said ties and said continuous filaments are integrally molded from a plastic.

6. An automatic tie gun for applying flexible one-piece cable ties around a bundle of elongate cables, each tie having a generally flat tie body including a flat tail portion and an apertured head portion at opposite ends of said tie body, said tie tail and head portions lying in a substantially common plane, the gun comprising means for indexing each tie into a tail-forward ready position within said gun, means for driving each indexed flat tie tail-first from said gun around the cable bundle, means for guiding the flat tie tail around said cable bundle as it is driven from said gun so that said flat tie tail is spaced apart from said aligned with said tie head aperture, and tie-threading means for threading said tie-head onto said tie tail, said tie-threading means being capable of reciprocatable movement generally perpendicular to the plane of said flat tie, for threading said tie head onto said flat tie tail in a first movement and carrying the interlocked tie head and tail in a return direction in a second movement after said tie is driven into said tie guiding means.

7. An automatic tie gun for applying flexible, one-piece cable ties around a bundle of elongate cables, each tie having a generally flat tail and an apertured head lying in a substantially common plane at opposite ends of said ties, comprising:

means for indexing each tie into a tail-forward and flat position within said gun, means for driving said indexed tie in a tail-first position from said gun including a rotatable pinch wheel adapted to engage said flat tie tail, means at the forward end of said gun for guiding the tie tail of a driven tie around said cable bundle as the tie is driven from said gun such that said tie tail passes through said apertured tie head to interlock therewith and a rotatable cam wheel spaced apart from said pinch wheel and adapted to engage the tie head of said driven tie and push said driven cable tie head past said driving pinch wheel into proper alignment in said guide means.

8. The automatic tie gun of claim 7, wherein said driving wheel further includes a plurality of teeth disposed about its periphery in a preselected spacing and adapted to engage complimentary serrations in said flat tie tail.

9. An automatic tie gun for applying a single elongate, flexible one-piece cable tie around a bundle of cables, each tie having a generally flat tail portion and apertured head portion at opposite ends thereof and being separated within said gun from an interconnected supply of ties arranged in the form of a bandolier of ties in which individual ties are interconnected adjacent their respective head and tail portions, the gun comprising:

a housing;

tie-indexing means for advancing said bandolier and advancing a single leading tie separated from said bandolier into a tail-forward position within said housing;

means for separating said leading tie from said bandolier;

means for driving said separated and advanced leading tie tail-first from said gun around said cable bundle;

means at the forard end of said gun for guiding said tie tail of a driven tie around said cable bundle in a loop as said tie is driven from said gun whereby said tie tail is spaced apart from said tie head aperture and positioned in alignment therewith, and gate means operatively associated with said tie-indexing means for guiding said bandolier to said indexing means, said gate including an entry slot adapted to engage substantially the entire length of the leading tie of said bandolier, said gate being further adapted for movement between a receiving position and an operating position, whereupon movement of said gate to said operating position operatively engages substantially the entire length of said leading tie of said bandolier with said indexing means.

10. The automatic tie gun of claim 9, wherein said indexing means further includes a rotatable shaft having a plurality of rotatable discs axially spaced thereon, each of said discs having a plurality of lateral recesses circumferentially spaced thereon which are adapted to engage successive ties of said bandolier, whereby rotation of said discs moves each successive leading tie into a ready position within said gun, said movement of said gate into said operating position causing said bandolier leading tie to engage said disc recesses.

11. The automatic tie gun of claim 10, wherein said gate is pivotally mounted on said gun for movement between said operating and receiving positions.

12. The automatic tie gun of claim 10, wherein said separating means further includes fixed cutting blades disposed in the path of said tie bandolier between said gate means and said indexing means, whereby each successive leading tie of said bandolier is separated in succession from said filaments as said bandolier is advanced in said gun by said indexing means.

13. An automatic tie gun for applying a flexible, one-piece tie around a bundle of cables, the tie having a tie body including a generally flat tie tail and an apertured tie head at opposite ends thereof, comprising:

means for advancing said tie into a tail-forward position within said gun;

means for driving said advanced tie tail-first from said gun;

means for guiding the tie tail of a driven tie around said cable bundle at the forward end of said gun as said tie is driven from said gun, whereby said flat tie tail passes through said tie head aperture in interlocking engagement therewith;

tie-tensioning means for tensioning the interlocked tie around said cable bundle including a rotatable driven wheel spaced apart from said guide means and adapted to engage the free end of said tie tail projecting through said head and to tension said tie around said cable bundle;

a motor, and transmission means for transmitting drive from said motor to said tie-tensioning wheel including a clutch adapted to slip upon attainment of a preselected tension in said tie by said tensioning wheel, whereby said clutch interrupts the transmission of drive to said tensioning wheel, and whereupon said clutch operatively engages a cutter to sever said tie tail substantially flush with said tie head.

14. In a combination for automatically applying an individual flexible tie from a supply of individual interconnected flexible ties around an elongate bundle of wires, each of the ties having a tie body having a flat tail portion and an operational head portion at opposite ends of said tie body, said tie tail and head portions lying in a flat plane, said flat tail portion further including a series of transverse serrations adapted to engage an aperture in said tie head portion, said combination including a tool and said supply of interconnected flexible ties, the combination comprising:

a series of individual flexible ties assembled in the form of a belt wherein individual ties are disposed side-by-side in a flat plane and in generally parallel and flat relationship with each other, said individual flexible ties being interconnected successively with one another in a predetermined spacing by two integral flexible continuous filaments adjacent the head and tail portions of individual flat ties at opposite ends of said ties so as to form a tie supply bandolier, said filaments extending the entire length of said bandolier generally perpendicular to said individual ties whereby said individual ties are maintained in said predetermined spacing and generally parallel relationship with each other and generally perpendicular to said continuous filaments in the same flat plane to facilitate receipt of individual ties onto a tie tool indexing means,each of said filaments being adapted to be driven to waste as single, integral waste pieces when separated within said gun from said individual ties; and a tie tool adapted to receive said tie supply bandolier, and apply an individual tie separated from said bandolier within said tool around said wire bundle, the tool including indexing means for receiving the leading tie of said tie supply bandolier and positioning said tie in a tail-forward application position within said tool for application around said wire bundle, means for separating an individual leading tie from said tie supply bandolier for use in said tie tool by severing said continuous bandolier filaments adjacent said tie head and tail portions as said leading ties of said bandolier are advanced. by said tie-indexing means, tie-driving means including a rotatable wheel for driving each separated leading tie out of said tool and around said wire bundle, guide means at the forward end of said tool for guiding each separated driven individual tie around said wire bundle, said guide means further aligning each said driven tie such that the free end of said tie tail is spaced apart from said tie head aperture and positioned in alignment therewith in said guide means, means for threading said tie tail of said driven tie through said apertured tie head to interlock therewith, tie-tensioning means for tensioning said driven tie around said wire bundle including a rotatable wheel adapted to engage said free end of said tie tail once passed through said apertured head by said threading means, a knife for cutting said tie tail of said tensioned tie behind said tie head and tension-sensing means for actuating said knife when a predetermined tension in said tie is reached.

15. The combination of claim 14, wherein said tie-driving wheel includes a plurality of teeth circumferentially disposed thereon which are complimentary in shape to transverse serrations extending along said tie tail and adapted to engage said tie tail serrations, each of said wheel teeth being spaced apart in a preselected spacing such that each successive wheel tooth engages a successive complimentary tie serration.

16. The combination of claim 14, wherein said tie-driving means further includes a rotatable cam wheel driven by motor means for pushing said cable tie head past said tie-driving means and into said guide means upon engagement of said cable tie head with cam wheel, said cam wheel being spaced apart from said tie-driving means to provide a reaction surface for said tie-driving means.

17. The combination of claim 14, wherein said tool tie-threading means is capable of reciprocating movement, said tie-trheading means pushing said tie head over said tie tail into interlocking engagement therewith in its first movement such that the free end of said tie tail projects through said aperture and raising said interlocked tie tail and head in areturn direction in its second reciprocal movement.

18. The combination of claim 17, wherein said free end of said tie tail is brought into engagement with said tie-tensioning wheel by said second movement of said threading means, said tensioning wheel including a series of teeth circumferentially spaced thereon which are adapted to engage said tie tail serrations.

19. The combination of claim 14, wherein said tie tool further includes exit means for receiving and driving to waste said continuous bandolier filaments severed from said individual ties.

20. The combination of claim 14, wherein said ties and said continuous filaments are integrally molded from a plastic.

21. An automatic tie gun for applying flexible, one-piece cable ties around a bundle of elongate cables, each tie having a generally flat tail and an apertured head lying in a substantially common plane at opposite ends of said ties, comprising:

means for indexing each tie into a tail-forward and flat position within said gun, means for driving said indexed tie in a tail-first position from said gun including a rotatable pinch wheel adapted to engage said flat tie tail, said driving pinch wheel further including a plurality of teeth disposed about its periphery in a preselected spacing and adapted to engage complimentary serrations in said flat driven tie tail, means at the forward end of said gun for guiding the tie tail of a driven tie around said cable bundle as the tie is driven from said gun such that said tie tail passes through said apertured tie head to interlock therewith, and a rotatable cam wheel spaced apart from said pinch wheel and adapted to engage the tie head of said driven tie and push said driven cable tie head past said driving pinch wheel into proper alignment in said guide means.

22. In a combination for automatically applying an individual flexible tie from a supply of individual interconnected flexible ties around an elongate bundle of wires, each of the ties having a tie body having a flat tail portion and an operational head portion at opposite ends of said tie body, said tie tail and head portions lying in a flat plane, said flat tail portion further including a series of transverse serrations adapted to engage an aperture in said tie head portion, said combination including a tool and said supply of interconnected flexible ties, the combination comprising:

a series of individual flexible ties assembled in the form of a belt wherein individual ties are disposed side-by-side in a flat plane and in generally parallel and flat relationship with each other, said individual flexible ties being interconnected successively with one another by two integral flexible continuous filaments adjacent the head and tail portions of individual flat ties so as to form a tie supply bandolier, said filaments extending the entire length of said bandolier generally perpendicular to said individual ties whereby said individual ties are maintained in said generally parallel relationship within the same flat plane; and a tie tool adapted to receive said tie supply bandolier, and apply an individual tie separated from said bandolier within said tool around said wire bundle, the tool including indexing means for receiving the leading tie of said tie supply bandolier and positioning said tie in a tail-forward application position within said tool for application around said wire bundle, means for separating an individual leading tie from said tie supply bandolier for use in said tie tool by severing said continuous bandolier filaments adjacent said tie head and tail portions as said leading ties of said bandolier are advanced by said tie-indexing means, tie-driving means including a rotatable wheel for driving each separated leading tie out of said tool and around said bundle, guide means at the forward end of said tool for guiding each separated driven individual tie around said wire bundle, said guide means further aligning each said driven tie such that the free end of said tie tail is spaced apart from said tie head aperture and positioned in alignment therewith in said guide means, said tie driving means further including a rotatable cam wheel driven by motor means for pushing the cable tie head of said driven tie past said tie-driving means and into said guide means, said cam wheel being spaced apart from said tie driving means to provide a reaction surface for said tie driving means, means for threading said tie tail of said driven tie through said apertured tie head to interlock therewith, tie-tensioning means for tensioning said driven tie around said wire bundle including a rotatable wheel adapted to engage said free end of said tie tail once passed through said apertured head by said threading means, a knife for cutting said tie tail of said tensioned tie behind said tie head and tension-sensing means for actuating said knife when a predetermined tension in said tie is reached.

23. In a combination for automatically applying an individual flexible tie from a supply of individual interconnected flexible ties around an elongate bundle of wires, each of the ties having a tie body having a flat tail portion and an operational head portion at opposite ends of said tie body, said tie tail and head portions lying in a flat plane, said flat tail portion further including a series of transverse serrations adapted to engage an aperture in said tie head portion, said combination including a tool and said supply of interconnected flexible ties, the combination comprising:

a series of individual flexible ties assembled in the form of a belt wherein individual ties are disposed side-by-side in a flat plane and in generally parallel and flat relationship with each other, said individual flexible ties being interconnected successively with one another by two integral flexible continuous filaments adjacent the head and tail portions of individual flat ties so as to form a tie supply bandolier, said filaments extending the entire length of said bandolier generally perpendicular to said individual ties whereby said individual ties are maintained in said generally parallel relationship within the same flat plane; and a tie tool adapted to receive said tie supply bandolier, and apply an individual tie separated from said bandolier within said tool around said wire bundle, the tool including indexing means for receiving the leading tie of said tie supply bandolier and positioning said tie in a tail-forward application position within said tool for application around said wire bundle, means for separating an individual leading tie from said tie supply bandolier for use in said tie tool by severing said continuous bandolier filaments adjacent said tie head and tail portions as said leading ties of said bandolier are advanced by said tie-indexing means, tie-driving means including a rotatable wheel for driving each separated leading tie out of said tool and around said bundle, guide means at the forward end of said tool for guiding each separated driven individual tie around said wire bundle, said guide means further aligning each said driven tie such that the free end of said tie tail is spaced apart from said tie head aperture and positioned in alignment therewith in said guide means, means for threading said tie tail of said driven tie through said apertured tie head to interlock therwith capable of reciprocating movement, said tie-threading means pushing said apertured tie head over said tie tail into interlocking engagement therewith in its first movement such that the free end of said tie tail projects through said head aperture said tie-threading means raising said interlocked tie tail and head in a return direction in its second, reciprocal movement, tie-tensioning means for tensioning said driven tie around said wire bundle including a rotatable wheel adapted to engage said free end of said tie tail once passed through said apertured head by said threading means, a knife for cutting said tie tail of said tensioned tie behind said tie head and tension-sensing means for actuating said knife when a predetermined tension in said tie is reached.

24. The combination of claim 23, wherein said free end of said tie tail is brought into engagement with said tie-tensioning wheel by said second movement of said threading means, said tensioning wheel including a series of teeth circumferentially spaced thereon which are adapted to engage said tie tail serrations.

* * * * *

UNITED STATES PATENT AND TRADEMARK OFFICE

CERTIFICATE OF CORRECTION

PATENT NO. : 4,640,320

DATED : February 3, 1987

INVENTOR(S) : Gerald Avison, John W. Teape, Paul H. F. Willer

It is certified that error appears in the above-identified patent and that said Letters Patent is hereby corrected as shown below:

Column 5, line 65, "prssure" should read --pressure--.

Column 7, line 60, "wil" should read --will--.

Column 10, line 10, "experiences" should read --experienced--; line 41, "reciproate" should read --reciprocate--.

Column 13, line 12, "said" should read --and--; line 64, "forard" should read --forward--.

Column 15, line 34, after --advanced-- delete "."; line 67, after "with" insert --said--.

Column 16, line 5, "tie-trheading" should read --tie-threading--; line 9, "areturn" should read --a return--.

Column 18, line 33, "therwith" should read --therewith--.

Signed and Sealed this

Sixteenth Day of February, 1988

*Attest:*

*Attesting Officer*

DONALD J. QUIGG

*Commissioner of Patents and Trademarks*